US006082243A

United States Patent [19]

Schmücker et al.

[11] Patent Number: 6,082,243

[45] Date of Patent: Jul. 4, 2000

[54] FLUID CONTROLLED SWITCHING UNIT

[75] Inventors: Karl Joachim Schmücker, Eynatten, Belgium; Gunter Lothar Gürich, Aachen; Hermann Josef Laumen, Heinsberg, both of Germany

[73] Assignee: FEV Motorentechnik GmbH & Co. KG, Aachen, Germany

[21] Appl. No.: 09/039,497

[22] Filed: Mar. 16, 1998

[30] Foreign Application Priority Data

Mar. 15, 1997 [DE] Germany ..... 297 04 758

[51] Int. Cl.[7] ..... F15B 15/20

[52] U.S. Cl. ..... 91/392; 91/397; 91/465

[58] Field of Search ..... 91/392, 397, 462, 91/465, 466; 123/90.12

[56] References Cited

U.S. PATENT DOCUMENTS

| | | | |
|---|---|---|---|
| 5,193,495 | 3/1993 | Wood, III | 123/90.12 |
| 5,529,030 | 6/1996 | Rose | 123/90.12 |
| 5,531,192 | 7/1996 | Feucht et al. | 123/90.12 |
| 5,595,148 | 1/1997 | Letsche et al. | 91/392 X |

*Primary Examiner*—Hoang Nguyen
*Attorney, Agent, or Firm*—Venable; Gabor J. Kelemen

[57] ABSTRACT

A fluid controlled switching unit includes a valve block; a guide bore provided in the valve block; first and second work chambers provided in the valve block and spaced from one another; first and second cylinder bores provided in the valve body; and a plunger rod guided in the guide bore for reciprocating motion therein along a displacement path. The plunger rod has first and second piston faces situated in the first and second work chambers, respectively, and exposed to fluid pressure prevailing therein. The first and second piston faces move in the first and second cylinder bores, respectively. A valve body is attached to the plunger rod for forming a unitary structure therewith. The valve body has opposite pressure faces as well as first and second opposite end positions determining opposite ends of the displacement path. The valve body, when situated in one of the end positions, is exposed solely unilaterally to fluid pressure at one of the pressure faces thereof. There are further provided a pressurized fluid supply, a depressurized fluid return and a switch-over valve for alternatingly coupling the first and second work chambers to the pressurized fluid supply and the depressurized fluid return for effecting the reciprocating motion.

9 Claims, 7 Drawing Sheets

FLUID CONTROLLED SWITCHING UNIT

CROSS REFERENCE TO RELATED APPLICATION

This application claims the priority of German Application No. 297 04 758.2 filed Mar. 15, 1997, which is incorporated herein by reference.

BACKGROUND OF THE INVENTION

The use of fluid pressure controlled switching units for operating setting members, for example, valves or the like involves difficulties if the setting members have a relatively large mass and/or they must execute a large stroke within short switching periods. This problem is further aggravated in case the setting member has to be moved at a high cadence frequency. Because of the high displacement speeds and the resulting large acceleration forces, large driving power has to be made available.

SUMMARY OF THE INVENTION

It is an object of the invention to provide an improved fluid controlled switching unit which makes possible short switching periods with a small driving power even if large setting members have to be operated.

This object and others to become apparent as the specification progresses, are accomplished by the invention, according to which, briefly stated, the fluid controlled switching unit includes a valve block; a guide bore provided in the valve block; first and second work chambers provided in the valve block and spaced from one another; first and second cylinder bores provided in the valve body; and a plunger rod guided in the guide bore for reciprocating motion therein along a displacement path. The plunger rod has first and second piston faces situated in the first and second work chambers, respectively, and exposed to fluid pressure prevailing therein. The first and second piston faces move in the first and second cylinder bores, respectively. A valve body is attached to the plunger rod for forming a unitary structure therewith. The valve body has opposite pressure faces as well as first and second opposite end positions determining opposite ends of the displacement path. The valve body, when situated in one of the end positions, is exposed solely unilaterally to fluid pressure at one of the pressure faces thereof. There are further provided a pressurized fluid supply, a depressurized fluid return and a switch-over valve for alternatingly coupling the first and second work chambers to the pressurized fluid supply and the depressurized fluid return for effecting the reciprocating motion.

It is particularly expedient to use resetting springs with the work piston.

The pressurized medium according to the invention may be gaseous or liquid. The term "plunger rod" is intended to mean not only the plunger rod disposed in the switching unit itself, but also the setting members which are to be operated and which are connected with the plunger rod. Dependent upon the structural design, the plunger rod, together with the piston and the valve body alone or together with the setting member, on the one hand, and—if present—the resetting springs, on the other hand, form a spring/mass system to be moved by the pressurized fluid.

It is an advantage of the fluid controlled switching unit according to the invention that its force/displacement characteristic is similar to an electromagnetic actuator, and accordingly, it lends itself for use in environments in which heretofore only electromagnetic actuators have been used.

A particular advantage of the switching unit according to the invention resides in that the motion of the plunger is effected by the work pistons (the piston faces on the plunger rod) and further, by means of the arrangement of the piston-like valve body it is feasible to hold the plunger rod in the predetermined terminal position during a freely selectable period without increasing the work pressure. The operating frequency and also the holding period are determined by controlling the switch-over valve which is coupled with a suitable drive means. If resetting springs are used, in a depressurized state the system is, dependent upon the design of the two oppositely operating resetting springs, in a mid position from which the plunger rod has to be displaced. This may be effected, for example, by applying alternating pressure thrusts to the work pistons or by a unilateral pressure increase until a terminal position is reached or by an additionally provided starting piston which may be coupled with the fluid pressure supply.

According to an advantageous embodiment of the invention the effective pressure face of the valve body is greater than the effective pressure face of the piston faces on the plunger rod. It is an advantage of such an arrangement that for the displacement itself only small volumes of the pressurized fluid need to flow and further, upon reaching the respective end position, the system may be held there only by virtue of the greater effective pressure face of the valve body and thus no pressure increase is needed.

According to another, particularly advantageous embodiment of the invention, at least one valve body is associated with and spaced from the two work pistons. The diameter of the valve body is less that the diameter of the work chamber and further, at least one of the end faces of the work chamber associated with the respective end of the valve body is designed as a hermetic seat for the valve body. Such an arrangement has the advantage that the valve body may practically freely move in the work chamber apart from small frictional losses due to the re-direction of the pressurized fluid during displacement. Accordingly, during motion of the valve body, the larger pressure face of the valve body is without effect even if, in the work chamber, the pressurized fluid is under the working pressure determined by the fluid pressure supply. The pressure face of the valve body becomes effective when the latter engages the valve seat in the respective end position of the valve body, whereupon the fluid, pressurized at the predetermined working pressure, becomes effective.

DESCRIPTION OF THE PREFERRED EMBODIMENTS

Figure 1:
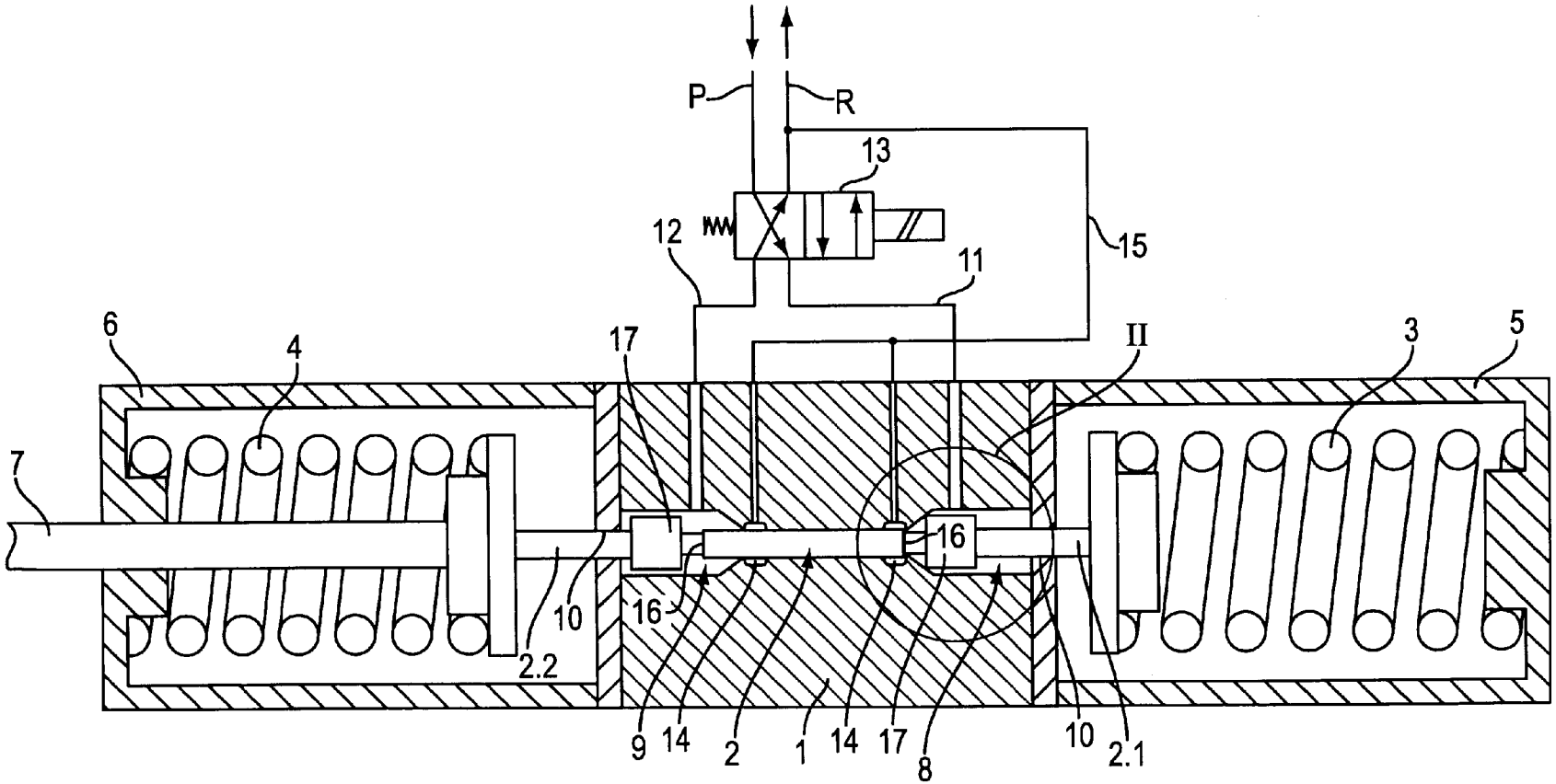
FIG. 1 is an axial sectional view, with block diagram, of a preferred embodiment of the invention, having two valve bodies.

Turning to FIG. 1, the fluid controlled switching unit shown therein includes a valve block 1 in which a plunger rod 2 may be reciprocated against the force of resetting coil springs 3 and 4. The resetting springs 3 and 4 are accommodated in respective spring housings 5 and 6. The plunger rod 2 is, on the side of the resetting spring 4, coupled with a connecting rod 7 which, in turn, operates a setting member such as a non-illustrated valve.

The valve block 1 defines two work chambers 8 and 9 from which extend prolongations 2.1 and 2.2 of the plunger rod 2 through sealed passages 10.

The work chambers 8 and 9 may communicate by means of conduits 11 and 12 with a pressurized fluid supply not illustrated in detail and symbolized by a pressure conduit P and with a non-illustrated sump (fluid return) symbolized by a return conduit R. The two work chambers 8 and 9 may be alternatingly coupled to the pressure supply P and may thus be charged with high pressure by means of a controllable, 4/2-way switch-over valve 13. In the region of the passage opening for the plunger rod 2 the mutually facing ends of the work chambers 8 and 9 are cylindrical and form a valve seat. This construction will be described in greater detail later with reference to FIGS. 2, 3 and 7. The chamber cylinders are adjoined in the valve block 1 by relief chambers 14 which are connected to the fluid return R by means of a conduit 15.

The plunger rod 2 is provided at both ends with annular grooves which form part of respective work pistons 16. This arrangement too, will be explained in more detail in conjunction with FIGS. 2, 3 and 7. In each work chamber 8 and 9 the plunger rod 2 has, at a distance from the work piston 16, a valve body 17 whose outer diameter is less than the diameter of the associated work chamber.

For a normal case the two resetting springs 3 and 4 are of identical design so that in the depressurized state the plunger rod 2 assumes a symmetrical mid position with its two work pistons 16 and valve bodies 17.

If, by means of an appropriate setting of the switch-over valve 13, for example into the illustrated switching position, the work chamber 8 is charged from the conduit 11 with pressurized fluid whose pressure is set such that the combined force of the resetting springs 3 and 4 is overcome, the plunger rod 2 is moved into its terminal position illustrated in FIG. 1. If thereafter the switch-over valve 13 is alternatingly switched by means of a non-illustrated switching drive (switch-over valve control), the plunger rod 2 is moved back and forth so that the non-illustrated setting member connected therewith by means of the connecting rod 7 is also reciprocated (for example, a valve may be moved back and forth into open and closed positions). By virtue of the relatively small masses to be moved and the small fluid volumes to be displaced, it is possible to move the switching unit back and forth with a high switching frequency. The operating pressure may be less than the starting (triggering) pressure.

Figure 2:
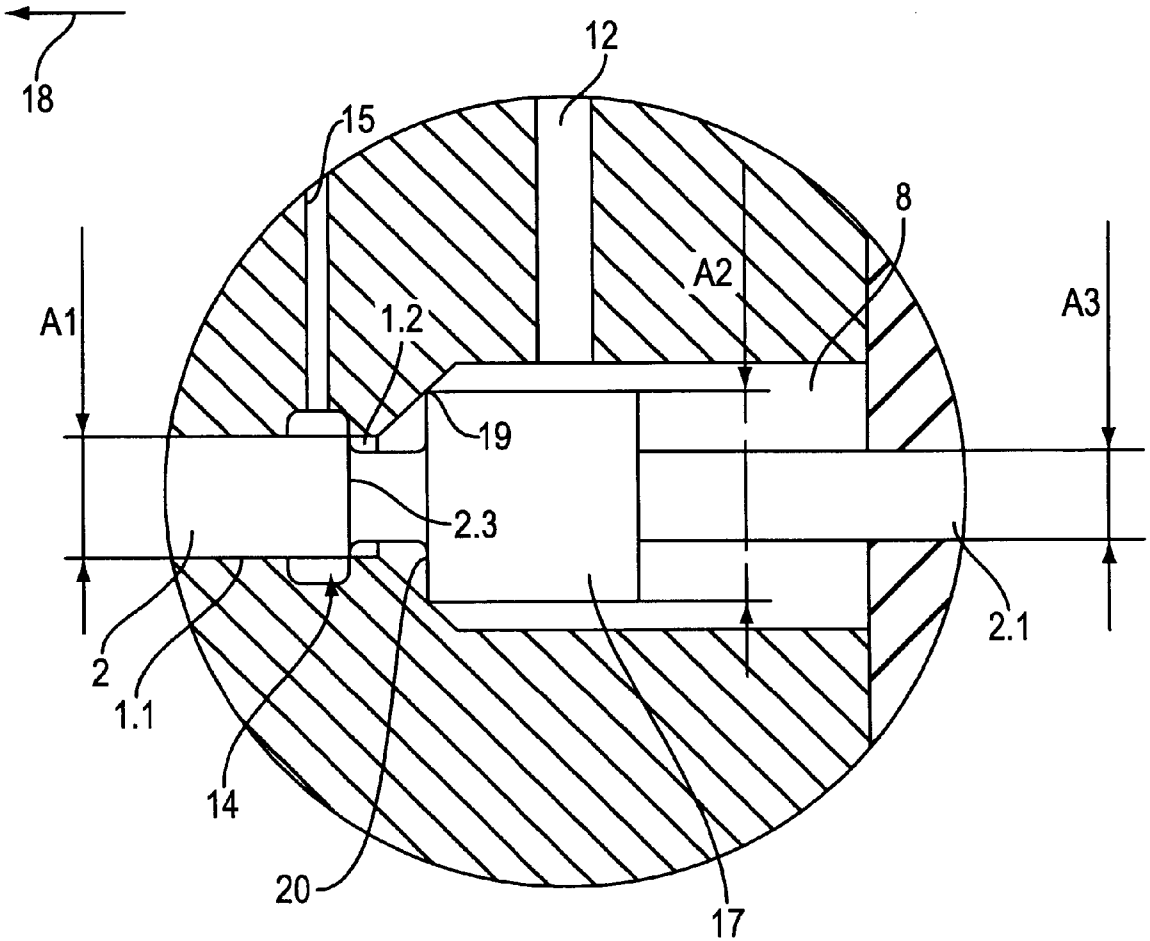
FIG. 2 is an enlarged view of the inset II of FIG. 1.

As seen in FIG. 2, that part of the plunger rod 2 which is guided in the valve block 1 has a greater diameter than that of the extensions 2.1 and 2.2. As a result, in case of a cross-sectional area A1 of that portion of the plunger rod 2 which is guided in the housing 2 and a cross-sectional area A3 of the extension 2.1, an effective piston face K=A1−A3 is obtained. In case the work chamber 8 is charged with a high pressure, there is obtained a displacing force B=p(A1−A3), as shown by the arrow 18. The displacing force B overcomes the frictional forces affecting the plunger rod 2.

The valve body 17 connected with the plunger rod 2 has a cross-sectional area A2 which is greater that the cross-sectional area A1 or the cross-sectional area A3.

The circumferential edge 19 of the valve body 17 oriented towards the cylindrical guide face 1.1 of the valve block 1 is designed as a sealing edge, while the adjacent end face 20 of the work chamber 8 functions as a valve seat defined by the shown conical shape. Thus, as soon as the seating face of the valve body 17 arrives into engagement with the valve seat 20, a larger effective face V=A2−A3 is exposed to the pressure medium in the work chamber 8, so that in case the pressure in the work chamber 8 remains the same, the valve body 17 and thus also the setting member to be operated may be held in the terminal position with a correspondingly greater holding force.

To ensure that the seating face of the valve body 17 reliably engages the valve seat provided on the end face 20 of the work chamber 8, at a small distance from the opening of the passage region 1.2 the pressure relief chamber 14 is arranged which communicates with the return conduit 15. Accordingly, in the passage region 1.2 the plunger rod 2 has a lesser cross section, so that upon motion of the plunger rod 2 into the terminal position, the plunger rod 2 first works as a piston as described before. However, as soon as the valve body 17 arrives in the close vicinity of its terminal position, the passage region 1.2 is exposed by virtue of the slight undercut, resulting in a lesser cross-sectional surface, so that a direct connection between the work chamber 8 and the return conduit 15 is established. Such a connection, however, is limited by the volume blocked off by the valve body 17 at the valve seat 20. The circumferential edge 2.3 of the plunger rod 2 thus simultaneously works as a plunger valve which opens at that location, so that a rapid outflow of the pressurized fluid is ensured as the valve body 17 assumes its seat.

In case the switch-over valve 13 is switched and thus the work chamber 9 is charged with pressurized fluid from the pressurized fluid supply P and the work chamber 8 is in communication with the fluid return R, the plunger rod 2 moves in a direction opposite to the arrow 18 and after the valve body 17 lifts off its seat, the pressure relief chamber 14 is blocked. Such motion of the plunger rod 2 occurs because the pressure relief chamber 14 is always in communication with the fluid return R and the motion of the plunger rod 2 occurs based on the pressure difference and the spring force. During such a motion practically only the fluid volume displaced by the piston face A1−A3 is driven into the fluid return R, while the pressure face of the valve body 17 is surrounded by the pressurized fluid contained in the work chamber 8 or 9.

Since the "valve cross-over" defined by the terminal edge 2.3 on the plunger rod 2 must be sufficiently large to ensure an outflow of the pressurized fluid shortly before the seating of the valve body 17, at high displacement speeds which even in case of small masses lead to relatively large mass forces, the collision of the valve body 17 with its valve seat may be relatively hard.

Figure 3:
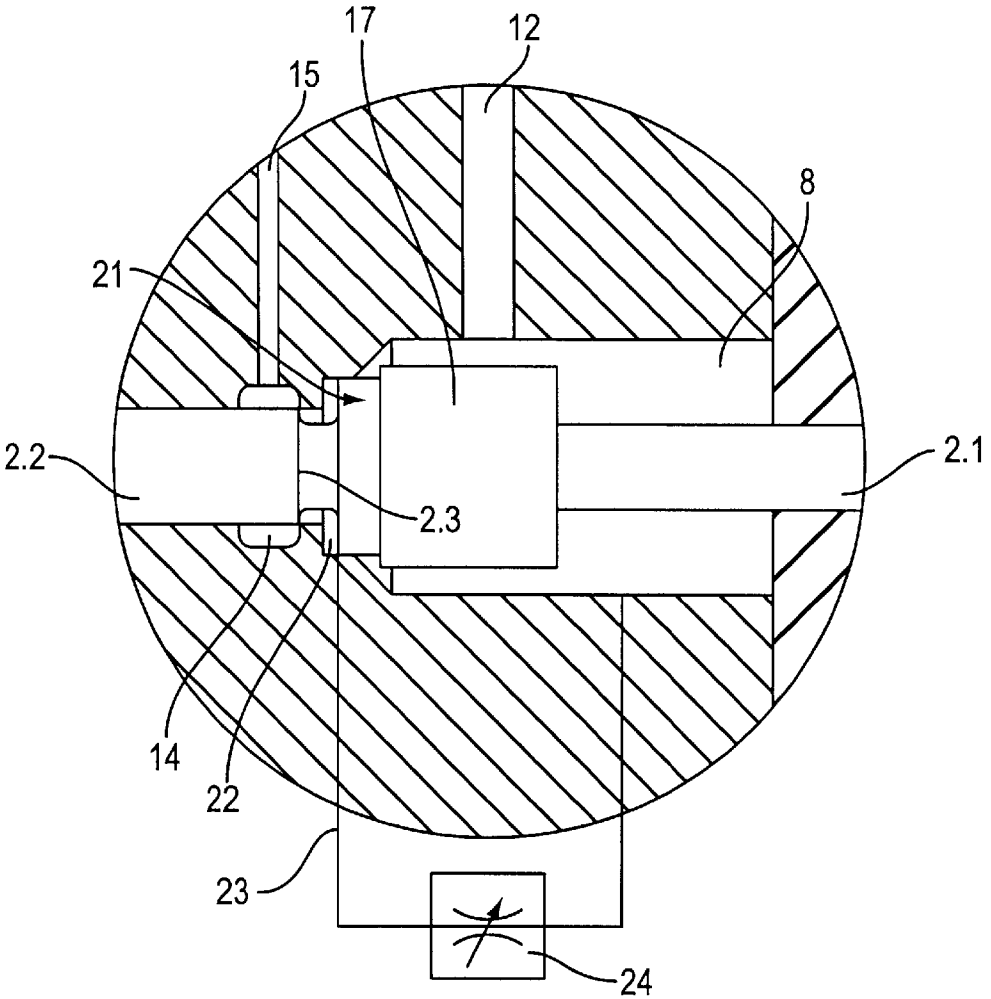
FIG. 3 is a view similar to FIG. 2, showing a variant.

Also referring to FIG. 3, in order to prevent such a hard impacting, at one end face 20 of the valve body 17 instead of a sealing edge 19 as shown in FIG. 2, an attachment constituted by a damping piston 21 is provided which, in the end position, penetrates into a corresponding recess 22 formed as a damping cylinder in the region of the passage 1.2. The damping piston 21 at the same time forms a seal by acting like a plunger valve. If the switching unit is, for example, utilized to operate a seatable valve, then, because of the damping piston, there is no need for a "dual fitting", that is, the length dimension of the system needs to be only coordinated with the valve seat. Tolerances, for example as a result of heat expansion, are compensated for by the damping piston 21.

The damping cylinder 22 may be coupled with the work chamber 8; such a connection is intended to work as a throttle. This arrangement may be effected by means of a connecting conduit 23 which may contain an adjustable throttle 24. Or, in an arrangement where the valve body 17 is configured as a seatable valve according to FIG. 2 and is provided with a damping piston, the throttling may be effected by so dimensioning the damping piston 21 that a small clearance is maintained between the inner wall of the damping cylinder 22 and the outer circumference of the damping piston 21.

It will be recognized in both constructions that upon a motion of the valve body 17 in the direction of its terminal position, by virtue of a suitable distance between the shoulder 2.3 of the plunger rod 2.2 and the damping piston 21, first the damping piston 21 penetrates into the damping cylinder 22 and thus drives back one part of the pressurized fluid into the work chamber 8 through the connecting conduit 23. Only after the shoulder 2.3 allows communication between the passage 1.2 and the pressure relief chamber 14 may the still-remaining pressurized fluid flow in an unimpeded manner into the return conduit 15, so that the valve body 17 hermetically closes with its entire sealing face at full pressure in the work chamber.

As it may be observed in FIG. 1, in each end position one of the resetting springs is compressed (spring 4 in FIG. 1) so that the compressed resetting spring has a force excess with respect to the other resetting spring (spring 5 in FIG. 1). Such a force excess works against the additional holding force exerted by means of the valve body 17 in the end position. As soon as the system is switched by means of the switch-over valve 13, the compressed resetting spring accelerates the system in the direction of the other terminal position. During this occurrence the pressing force affecting the work pistons 16 is available and ensures that the system assumes its seat in the other end position as well.

Figure 4:
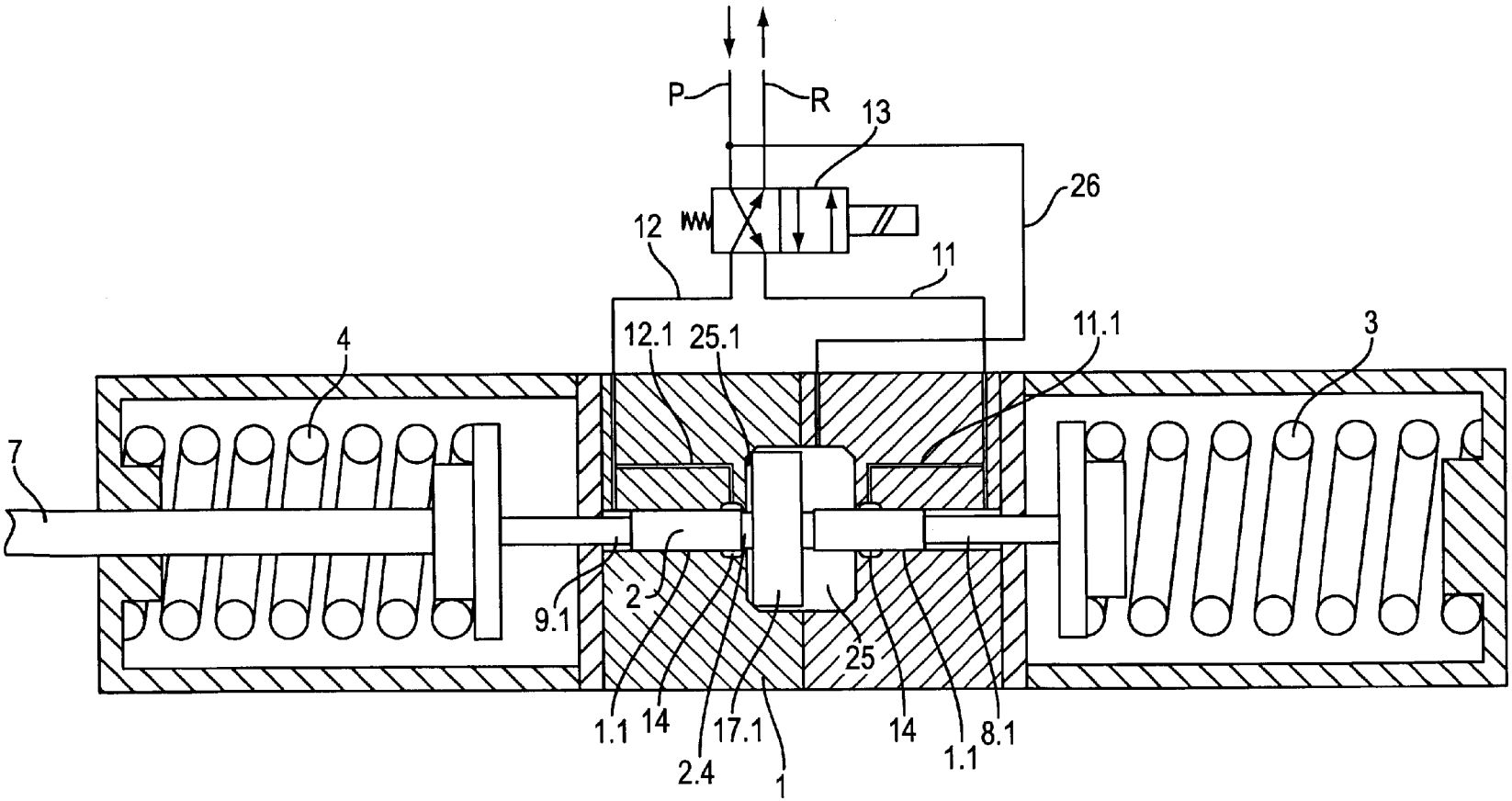
FIG. 4 is an axial sectional view, with block diagram, of another preferred embodiment of the invention, having a sole valve body operated by a pressurized gas.

While the embodiments illustrated in FIGS. 2 and 3 may be advantageously operated by a pressurized liquid, the embodiment shown in FIG. 4 is preferably used with a pressurized gas. The FIG. 4 structure is in principle identical to the embodiments according to FIGS. 1, 2 and 3. The significant difference in the embodiment according to FIG. 4 resides in that only a single valve body 17.1 is coupled with the plunger rod 2. The valve body 17.1 may be reciprocated in a work chamber 25 which is adjoined at both ends of the plunger rod 2 by correspondingly smaller work chambers 8.1 and 9.1. The latter are in communication through conduits 11 and 12 with a controllable switch-over valve 13 constituted by a 4/2-way valve. The work chamber 25 is in continuous communication with the pressurized fluid supply P by means of conduit 26.

In the embodiment illustrated in FIG. 4 the valve body 17.1 has a significantly larger cross-sectional area than that shown in the FIG. 1 embodiment. Otherwise, however, the valve body 17.1 is likewise provided with a sealing face and the work chamber 25 has a hermetic valve seat at both ends, formed, for example by respective conical walls.

As shown in FIG. 4, in the immediate vicinity of the valve body 17.1 the plunger rod 2 is provided with a circumferential grove 2.4 and the valve block 1 is provided with a pressure relief chamber 14, so that when the valve body 17.1 is seated in the end position, it seals off a chamber portion 25.1 which may be depressurized through the pressure relief chamber 14.

In the embodiment illustrated in FIG. 4 the pressure relief chambers 14 are not coupled directly with the fluid return R, but are connected to the conduits 11 and 12 leading to the switch-over valve 13 by respective branch conduits 11.1 and 12.1.

The movable assembly is held in the illustrated terminal position by the pressurized fluid in the work chambers 25 and 8.1. If now the switch-over valve 13 is switched, so that the application of pressure changes from the conduit 11 to the conduit 12, then not only the work chamber 9.1 but also the pressure relief chamber 14 is charged with working pressure. As a result, the valve body 17.1 is exposed in the work chamber 25 at both sides to the same pressure and, accordingly, the plunger rod 2 is moved only by virtue of the force derived from the work chamber 9.1, against the force of the resetting spring 3 despite the fact that the work chamber 25 continues to be charged with the high pressure from the pressure supply P. The small-volume pressurized fluid in the work chamber 8.1 may be driven into the fluid return R through the conduit 11. As soon as the valve body 17.1 is seated at that end of the work chamber 25 which is oriented towards the work chamber 8.1, for a short period of time communication is established via the pressure relief chamber 14 between the work chamber 25 and the pressure relief chamber 14 which, however, is blocked as soon as the valve body 17.1 assumes its position at the valve seat.

In the above described system of FIG. 4 too, the plunger rod 2, together with the non-illustrated setting member connected thereto by the connecting rod 7, can be reciprocated with high frequency without the need to move large volumes of the pressurized fluid.

Figure 5:
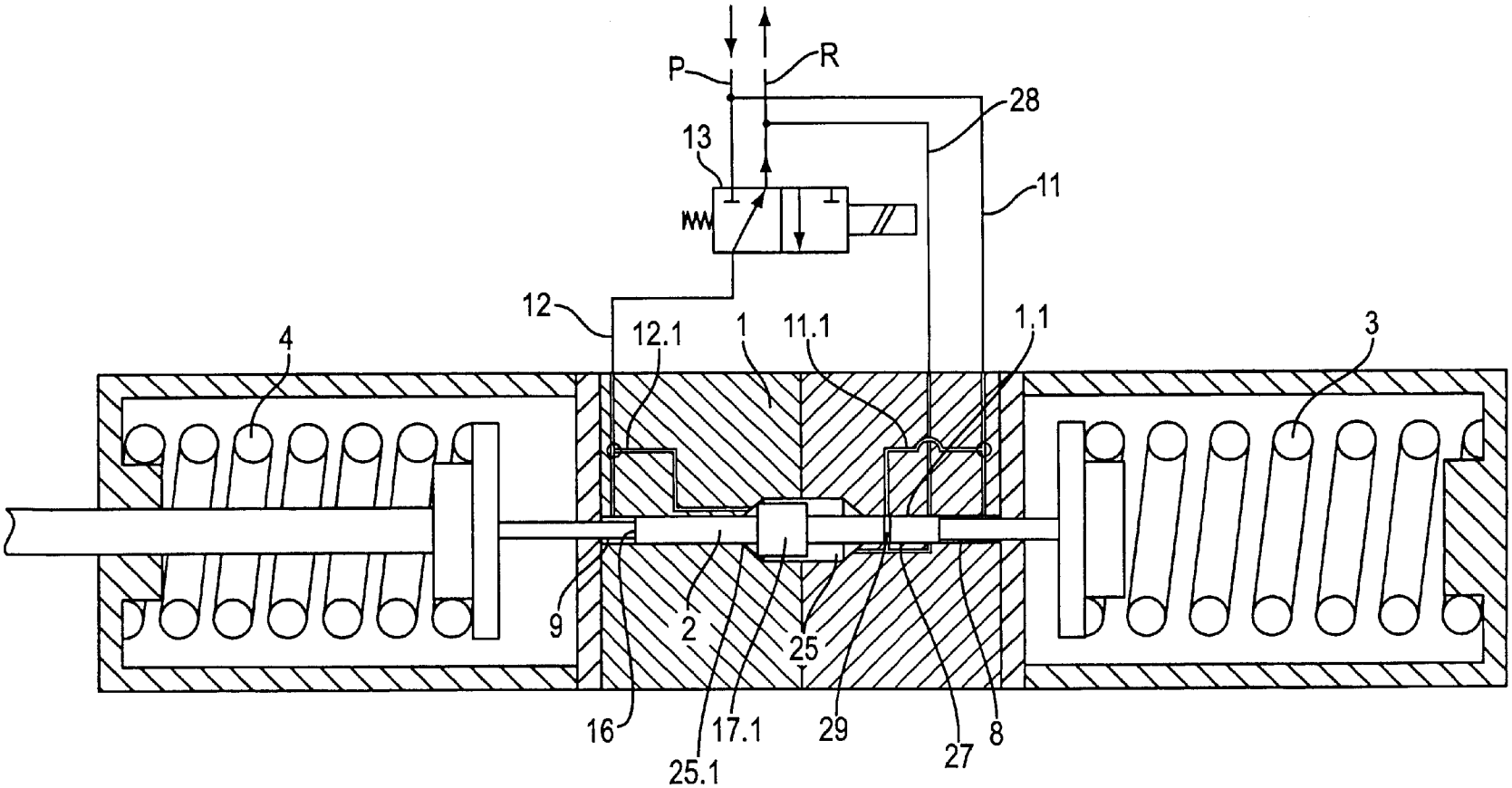
FIG. 5 is an axial sectional view, with block diagram, of yet another preferred embodiment of the invention, having a sole valve body operated by a pressurized liquid.

In FIG. 5 an embodiment modified as compared to FIG. 4 is shown, conceived in particular for use with a pressurized liquid. Here too, the basic construction corresponds to that described earlier. In the system according to FIG. 5, the switch-over valve 13 is a 3/2-way valve and is arranged such that the work chamber 9 may be selectively connected to the pressurized fluid supply P or the fluid return R through the conduit 12. The work chamber 8 is continuously connected with the pressurized fluid supply P by means of the conduit 11.

In the embodiment of FIG. 5, similarly to that shown in FIG. 4, only a single valve body 17.1 is used which may be reciprocated in a work chamber 25 situated between two work chambers 8 and 9. According to the embodiment shown in FIG. 5 the end region of the work chamber 25 oriented towards the work chamber 9 is connected with the conduit 12 by a branch conduit 12.1. On the side oriented towards the work chamber 8 the work chamber 25 communicates with a cross-over conduit 27 which, as explained in further detail later, may communicate with the fluid return R by means of the conduit 28 or may be coupled with the pressurized fluid supply P by a branch conduit 11.1 extending from the conduit 11. The plunger rod 2 is provided with an annular grove 29 which is so arranged with respect to the valve body 17.1 that in the end position of the latter, the work chamber 25 is coupled to the conduit 11 by means of the cross-over conduit 27 and the branch conduit 11.1. In this manner it is ensured that the pressurized liquid affects the plunger rod 2 not only via the work piston 16 in the work chamber 8 but also via the valve body 17.1 in the work chamber 25 and thus holds the plunger rod 2 in the end position.

Upon switching the switch-over valve 13, the work chamber 9 is charged with a pressurized fluid by the conduit 12, and the partial chamber 25.1, closed by the valve body 17.1, is also charged with pressurized fluid so that on both sides of the valve body 17.1 identical pressures prevail. This means that the holding force supplied by the pressurized fluid is removed. As a result, under the influence of the greater force of the resetting spring 4 the plunger rod 2 may be displaced in the direction of its other end position. The branch conduits 11.1 and 28 coupled to the cross-over conduit 27 open into the guide bore 1.1 for the plunger rod 2, similarly to the ends of the cross-over conduit 27. In each instance the communication is established by the annular grove 29 provided in the plunger rod 2.

As soon as the movable arrangement is displaced toward the other end position by the force of the resetting spring 4 after the switching of the switch-over valve 13 from the shown switching position into the other switching position, the branch conduit 11.1 connected with the pressurized fluid supply P is cut off by the shift of the annular grove 29, whereas the return conduit 28, upon reaching the end position of the valve body 17.1, is aligned with the groove 29 so that the chamber portion 25.1 is depressurized. The annular radial end face of the work piston 16 in the work chamber 8 is at such a distance from the valve body 17.1 that the work chamber 8 remains in communication with the pressurized fluid supply P even after the valve body 17.1 has reached its terminal position. To have the required force excess available upon a motion in the direction towards the return spring 3, the piston face of the work piston 16 in the work chamber 9 is greater than the piston face of the work piston 16 in the work chamber 8. If subsequently the switch-over valve 13 is switched back to its earlier state so that the conduit 12 communicates with the fluid return R, then for initiating the motion, the greater spring force of the return spring 3 and the preliminary pressure in the work chamber 8 affecting the (although smaller) face of the piston 16 are sufficient to move back the plunger rod 2 in the opposite direction, because the work chamber 9 is depressurized as a result of it being switched to the fluid return R.

Figure 6:
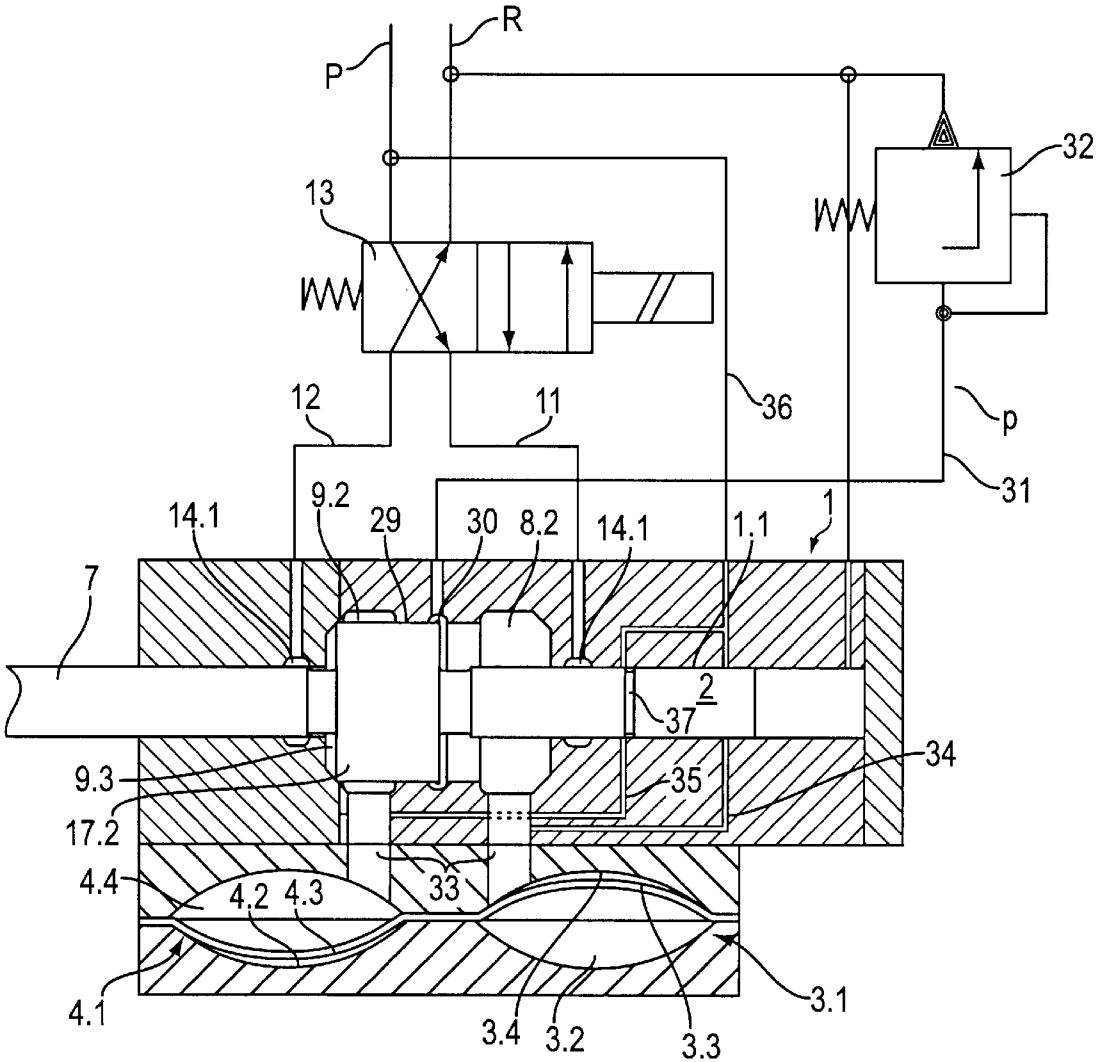
FIG. 6 is an axial sectional view, with block diagram, of still another preferred embodiment of the invention, having hydropneumatic resetting springs.

FIG. 6 shows a further embodiment of the invention in which hydropneumatic resetting springs are used instead of the mechanical resetting springs of the previously described embodiments. While the FIG. 6 embodiment too, may utilize either a pressurized liquid or a pressurized gas, it advantageously operates with a liquid.

It is a particular characteristic of the embodiment of FIG. 6 that in the valve block 1, at the plunger rod 2, a valve body 17.2 is arranged which is double-acting, similarly to the embodiments shown in FIGS. 4 and 5. A further characteristic of the embodiment of FIG. 6 resides in that the valve body 17.2 also functions as the work piston.

With the valve body 17.2 two work chambers 8.2 and 9.2 are associated which are connected to one another by an intermediate region formed as a cylinder 29 guiding therein the valve body 17.2 as a piston.

With the respective end positions of the valve body 17.2 annular pressure relief chambers 14.1 are associated which, as described in connection with FIG. 2, are connected by respective conduits 11 and 12 with the switch-over valve 13 formed as a 4/2-way valve. Dependent upon the switching position of the switch-over valve 13 the conduit 11 or the conduit 12 communicates with the fluid pressure supply P.

In the mid plane of the region of the cylinder 29 an annular chamber 30 is arranged which communicates with a pressure maintaining (pressure limiting) valve 32 by means of a conduit 31. The axial length of the valve body 17.2 is so dimensioned that in its respective end position the annular chamber 30 communicates with the other work chamber so that the latter is set by the pressure maintaining valve 32 to a predetermined pressure which is less than that obtained from the pressure supply P.

In the embodiment shown in FIG. 6 the resetting springs are constituted by biasable pneumatic accumulators 3.1 and 4.1. The work chambers 3.2 and 4.2 of the respective pneumatic accumulators 3.1 and 4.1 are charged with a pressurized gas and are separated from work chambers 3.4 and 4.4 by respective diaphragms 3.3 and 4.3.

The work chambers 3.4 and 4.4 are in communication with the respective work chambers 8.2 and 8.3 by means of conduits 33 so that, dependent upon the switching position, the pressurized gas is driven by the diaphragms 3.3, 4.3 through the conduits 33 into the respective work chamber as illustrated for the work chamber 8.2.

In the valve block 1 two transverse conduits 34 and 35 are provided which intersect the guide bore 1.1 for the plunger rod 2 and which communicate with the pressurized fluid supply P through a conduit 36. The conduits 34 and 35 open into the conduits 33 of the pneumatic accumulators 3.1 and 4.1 between the liquid chambers 3.4 and 4.4 and the respective work chambers 8.2 and 9.2.

In the region where the conduits 34 and 35 intersect the guide bore 1.1, the plunger rod 2 is provided with an annular grove 37 (forming a sliding valve) which establishes communication in the respective end position of valve body 17.2 between the conduit 34—or as shown in FIG. 6, between the conduit 35—and the pressurized fluid supply P through the conduit 36.

As may be seen in the illustration shown in FIG. 6, in the respective end position of valve body 17.2 the counteracting resetting spring—in the present instance the pneumatic spring 4.1—is shut off from the fluid return R by the valve body 17.2. At the same time, however, the respective supply conduit—in the present instance the conduit 35—is in communication with the conduit 36 so that the resetting spring 4.1 is biased via the fluid pressure supply P.

At the same time, in the respective end position the other resetting spring—in this instance the resetting spring 3.1—charges the respective work chamber—in this instance the work chamber 8.2—and the valve body 17.2 is thus maintained in its end position by a holding force.

If the switch-over valve 13 is switched to change the shown end position, the partial chamber 9.3 of the work chamber 9.2 closed by the valve body 17.2 is charged with high pressure. Since, by virtue of the pressure maintaining valve 32 in the work chamber 8.2 a lesser pressure prevails, the valve body 17.2 lifts off its valve seat and opens the supply conduit 33 of the resetting spring 4.1 so that the valve body 17.2 is pressed into its other end position by the resetting spring 4.1.

Immediately after the valve body 17.2 lifts off its seat; the conduit 35 is blocked because the annular groove 37 has shifted and, after the valve body 17.2 reaches the end position, the conduit 34 is unblocked by the annular groove 37. At the same time, during such a motion, the resetting spring 3.1 is biased and as the valve body 17.2 reaches the end position, the resetting spring 3.1 is maintained under pressure from the conduit 34. At the same time, in the new end position the annular chamber 30 communicates with the work chamber 9.2 so that in the latter the smaller pressure predetermined by the pressure maintaining valve 32 will prevail.

The structural details discussed in conjunction with FIGS. 2 and 3 may find application in all the embodiments.

Figure 7:
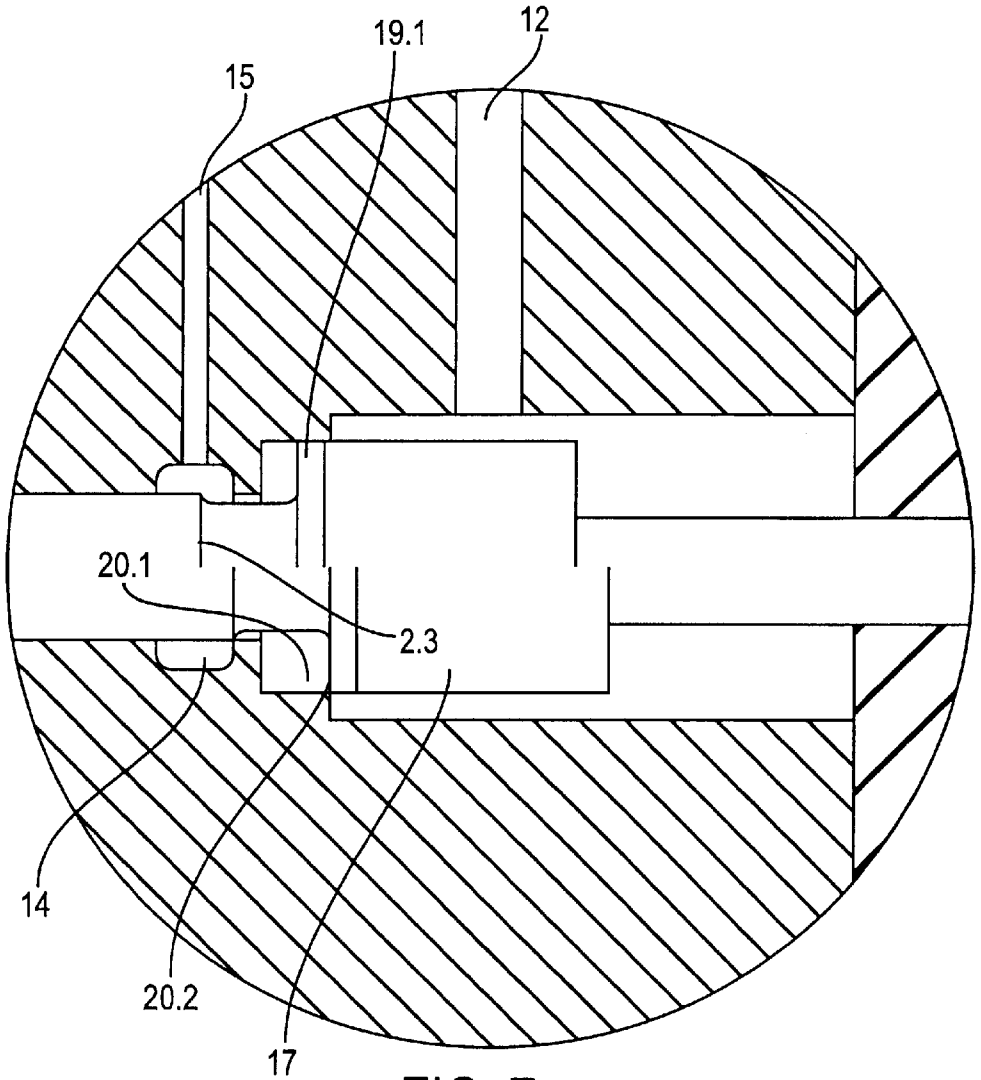
FIG. 7 is a view similar to FIG. 2, illustrating a further variant in two different positions.

Turning to FIG. 7, to avoid dual fittings, instead of the closing circumferential edge 19 at the valve body 17 (FIG. 2) the valve body 17 is configured as a piston and the end face 20 (FIG. 2) is accordingly formed as a cylinder face 20.1. A chamfer 19.1 ensures that upon reaching the seating edge 20.2 (lower half of the drawing) the pressure medium first flows by the valve seat at high speed, resulting in a damping effect. At the same time, in this position the control edge 23 establishes communication with the pressure relief chamber 14 so that the plunger rod is prevented with high reliability from rebounding. The valve body 17 is configured as a plunger valve in order to avoid a dual fitting in case the terminal position of the system is predetermined by the structural component to be operated by the fluid pressure controlled unit. A combination with an additional seatable valve is feasible as well.

It will be understood that the above description of the present invention is susceptible to various modifications, changes and adaptations, and the same are intended to be comprehended within the meaning and range of equivalents of the appended claims.

What is claimed is:

1. A fluid controlled switching unit comprising (a) a valve block;

(b) a guide bore provided in said valve block;

(c) first and second work chambers provided in said valve block and being spaced from one another;

(d) first and second cylinder bores provided in said valve block;

(e) a plunger rod guided in said guide bore for reciprocating motion therein along a displacement path; said plunger rod having first and second piston faces situated in said first and second work chambers, respectively, and being exposed to fluid pressure prevailing therein; said first and second piston faces moving in said first and second cylinder bores, respectively;

(f) a valve body attached to said plunger rod for forming a unitary structure therewith; said valve body having first and second opposite end positions determining opposite ends of said displacement path; said valve body having opposite pressure faces; said valve body, when situated in one of said end positions, being exposed solely unilaterally to fluid pressure at one of said pressure faces thereof;

(g) a pressurized fluid supply;

(h) a depressurized fluid return;

(i) switch-over valve means for alternatingly coupling said first and second work chambers to said pressurized fluid supply and said depressurized fluid return for effecting said reciprocating motion;

(j) a third cylinder bore provided in said valve block and being disposed between said first and second work chambers; said valve body being slidably accommodated in said third cylinder bore; said opposite pressure faces of said valve body being exposed to pressures prevailing in said first and second work chambers, respectively;

(k) first and second biasable pneumatic resetting springs communicating with said first and second work chambers, respectively; and (l) a sliding valve for establishing communication between said pressurized fluid supply and said first pneumatic resetting spring in said first end position to charge said first pneumatic resetting spring with pressurized fluid and for establishing communication between said pressurized fluid supply and said second pneumatic resetting spring in said second end position to charge said second pneumatic resetting spring with pressurized fluid.

2. The fluid controlled switching unit as defined in claim 1, wherein an effective pressure face of said valve body is greater than an effective piston face of said plunger rod.

3. The fluid controlled switching unit as defined in claim 1, wherein said first and second piston faces are annular, wherein said first and second work chambers adjoin said guide bore at opposite ends thereof and further wherein said first and second work chambers each have a diameter greater than a diameter of said guide bore.

4. The fluid controlled switching unit as defined in claim 1, wherein said valve body is accommodated in a valve body work chamber having a diameter greater than a diameter of said valve body; wherein said valve body work chamber has an end constituting a fluid tight valve seat for seating said valve body in at least one of said first and second end positions thereof.

5. The fluid controlled switching unit as defined in claim 1, further comprising first and second pressure relief chambers adjoining respective said first and second cylinder bores and being in communication with said depressurized fluid return; further comprising means for establishing communication between said first pressure relief chamber and said first cylinder bore in said first end position and for establishing communication between said second pressure relief chamber and said second cylinder bore in said second end position.

6. The fluid controlled switching unit as defined in claim 1, further comprising (a) a damping cylinder formed in said valve block;

(b) a conduit connecting said damping cylinder with said first work chamber;

(c) a throttle provided in said conduit; and (d) a damping piston axially adjoining said valve body and moving therewith as a unit; said damping piston being arranged so as to enter said damping cylinder shortly before said valve body reaches said first end position.

7. The fluid controlled switching unit as defined in claim 1, wherein said valve body is a first valve body disposed in said first work chamber; further comprising a second valve body disposed in said second work chamber; said first valve body, when situated in said first end position, being exposed solely unilaterally to fluid pressure at one of said pressure faces thereof; said second valve body, when situated in said second end position, being exposed solely unilaterally to fluid pressure at one of said pressure faces thereof.

8. The fluid controlled switching unit as defined in claim 1, wherein said valve body is a sole valve body; further comprising a third work chamber situated between said first and second work chambers and accommodating said valve body; said third work chamber having opposite ends each formed as a fluid tight seat for said valve body for seating said valve body in said first and second end positions, respectively.

9. The fluid controlled switching unit as defined in claim 1, further comprising (d) a pressure limiting valve;

(e) a return conduit containing said pressure limiting valve; said return conduit connecting said third cylinder bore with said fluid return; and (f) means provided on said valve body for effecting communication between said pressure limiting valve and said second work chamber in said first end position and for effecting communication between said pressure limiting valve and said first work chamber in said second end position to maintain said valve body in said first end position by a reduced pressure prevailing in said second work chamber and to maintain said valve body in said second end position by a reduced pressure prevailing in said first work chamber.

* * * * *